US010700449B2

(12) United States Patent
Serre et al.

(10) Patent No.: US 10,700,449 B2
(45) Date of Patent: Jun. 30, 2020

(54) SPLIT WEDGE CONNECTOR

(71) Applicant: ABB Schweiz AG, Baden (CH)

(72) Inventors: Jacob Serre, Ormond Beach, FL (US); Jorge Vigo, Ormond Beach, FL (US); Michael Cawood, Ormond Beach, FL (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/585,945

(22) Filed: Sep. 27, 2019

(65) Prior Publication Data

US 2020/0106197 A1 Apr. 2, 2020

Related U.S. Application Data

(60) Provisional application No. 62/738,584, filed on Sep. 28, 2018.

(51) Int. Cl.
*H01R 4/50* (2006.01)

(52) U.S. Cl.
CPC ..... *H01R 4/5091* (2013.01)

(58) Field of Classification Search
CPC ..... H01R 4/5083; H01R 4/50; H01R 4/32; H01R 4/2433; H01R 4/643; H01R 4/646; H01R 4/64
USPC ..... 439/783, 863, 780, 402, 100, 98, 92
See application file for complete search history.

(56) References Cited

U.S. PATENT DOCUMENTS

| | | | | |
|---|---|---|---|---|
| 3,462,543 | A * | 8/1969 | Wahl et al. | H01R 4/5083 174/94 R |
| 5,282,761 | A * | 2/1994 | Hollingsworth | H01R 4/5083 439/790 |
| 9,287,673 | B2 * | 3/2016 | Galla | H01R 43/01 |
| 2004/0203294 | A1 * | 10/2004 | Mello | H01R 4/5083 439/783 |
| 2006/0148333 | A1 * | 7/2006 | Peterson | H01R 4/5083 439/783 |
| 2006/0148334 | A1 * | 7/2006 | Conn | H01R 4/5083 439/783 |

OTHER PUBLICATIONS http://www.connectorproducts.com/tap-connectors.html, Connector Products Incorporated, 336.4-636 AAC Series Tap Connectors, Nov. 29, 2012, 1 pp.

* cited by examiner

*Primary Examiner* — Phuong Chi Thi Nguyen
(74) *Attorney, Agent, or Firm* — Taft Stettinius & Hollister LLP; J Bruce Schelkopf

(57) ABSTRACT

An apparatus and method relating to a split wedge connector that electrically couples a tap line to an overhead power line. The split wedge connector includes a clamp assembly and a wedge body. The tap line can be secured in a passageway of the wedge body while a worker is at ground level. The split wedge connector can then be lifted via a hot stick such that a portion of an overhead power line is received in the opened clamp assembly. The clamp assembly is then closed by adjusting the relative vertical position(s) of upper and/or lower clamp portions via manipulation of a clamp driver using the hot stick. The hot stick can then engage a wedge driver and be manipulated to facilitate horizontal displacement of the wedge body relative to the clamp assembly, thereby compressing the power line in the split wedge connector.

18 Claims, 7 Drawing Sheets

SPLIT WEDGE CONNECTOR

CROSS REFERENCE TO RELATED APPLICATIONS

The present application claims the benefit of U.S. Provisional Patent Application Ser. No. 62/738,584, which was filed on Sep. 28 2018, and is incorporated herein by reference in its entirety.

BACKGROUND

Embodiments of the present application generally relate to a wedge connector for connecting electrical cables or lines. More particularly, but not exclusively, embodiments of the present application relate to split wedge connector for securely coupling a tap line to an overhead power line.

Installation of tap cables or lines has typically involved the use of lift equipment, such as, for example, a cherry picker, to vertically lift a worker to a position at which the worker can connect the tap line to an overhead electrical power line via a wedge connector. Once lifted into position, a plurality of workers may use several tools, as well as other ancillary components, to securely connect the tap line to the power line via the wedge connector. For example, often installation of traditional wedge connectors involves at least two operators, with each worker separately, and often simultaneously, operating their own hot stick. Further, such installations can also involve workers initially installing a hot line clamp to control cables, such as both a main line and tap line, before a wedge connector can be installed. Further, once the lines are joined together via the hot line clamp, one worker may use a first hot stick to position a wedge clamp about the joined lines while another worker uses a second hot stick to install an interface tab between the joined lines, and then use a third hot stick to wedge the wedge connector into position. Additionally, certain wedge connectors utilize a fire-on method in which an explosive cartridge is used with an associated tool to provide a driving force to securely wedge the wedge connector in position, and thus secure the wedge connector to the overhead power line.

However, installations that rely on multiple works, devices, and tools, as well as reliance on lift equipment and explosive cartridges, can increase at least the cost and complexity of installation of wedge connectors, as well as create a variety of safety issues. For example, in at least certain parts of the country, and/or during certain seasons, reliance on explosive cartridges for installation may fail to comply with at least some state regulations. Additionally, reliance on a supply of explosive cartridges, as well as the reliance on the presence of a mechanical lift, such as a cherry picker, can increase installation and/or overhead costs, as well as increase the time of installation. Similarly, such costs can be further increased by the need to be prepared for misfires of the explosive cartridge, and the associated time to remove the misfired cartridge as well as reloading and retrying another explosive cartridge.

BRIEF SUMMARY

An aspect of an embodiment of the present application is a split wedge connector that includes a wedge body having an upper wall, a lower wall, and a passageway. The upper wall can extend along an incline between a first sidewall and a second sidewall of the wedge body. Further, according to certain embodiments, the passageway can comprise a through-hole that extends through the wedge body. The split wedge connector can also include a clamp assembly having an upper clamp portion, a lower clamp portion, and a clamp driver. The clamp driver can be configured to vertically displace the clamp assembly between an open position and a closed position. The upper clamp portion can have an inner surface that defines an upper orifice, and at least a portion of the inner surface that defines the upper orifice can comprise an inclined wall. Additionally, the clamp driver can have an eyebolt. The split wedge connector can also include a wedge driver that is coupled to the wedge body and the lower clamp portion. The wedge driver can be configured to horizontally displace at least one of the wedge body and the clamp assembly relative to the other of the wedge body and the clamp assembly. Further, the wedge driver can have an eyebolt. Additionally, according to certain embodiments, at least a portion of the lower wall of the wedge body can slidingly abut an abutment surface of the lower clamp portion while at least a portion of the upper wall faces the inclined wall.

Another aspect of an embodiment of the present application is a method that can include inserting a tap line through a passageway of a wedge body of a split wedge connector, the split wedge connector further including a clamp assembly, and lifting, using a hot stick and with the clamp assembly in an open position, the split wedge connector. Additionally, while the split wedge connector is lifted, a portion of an overhead power line can be received in an orifice of the opened clamp assembly. With the overhead power line in the orifice of the clamp assembly of the lifted split wedge connector, the clamp assembly can be closed. The wedge body can be displaced relative to the clamp assembly, through manipulation of a wedge driver via the hot stick, from an initial position to a final position. Such displacing of the wedge body relative to the clamp assembly to the final position can result in the compression of at least a portion of the overhead power line that is located in the orifice of the clamp assembly.

BRIEF DESCRIPTION OF THE DRAWINGS

The description herein makes reference to the accompanying figures wherein like reference numerals refer to like parts throughout the several views.

Figure 1:
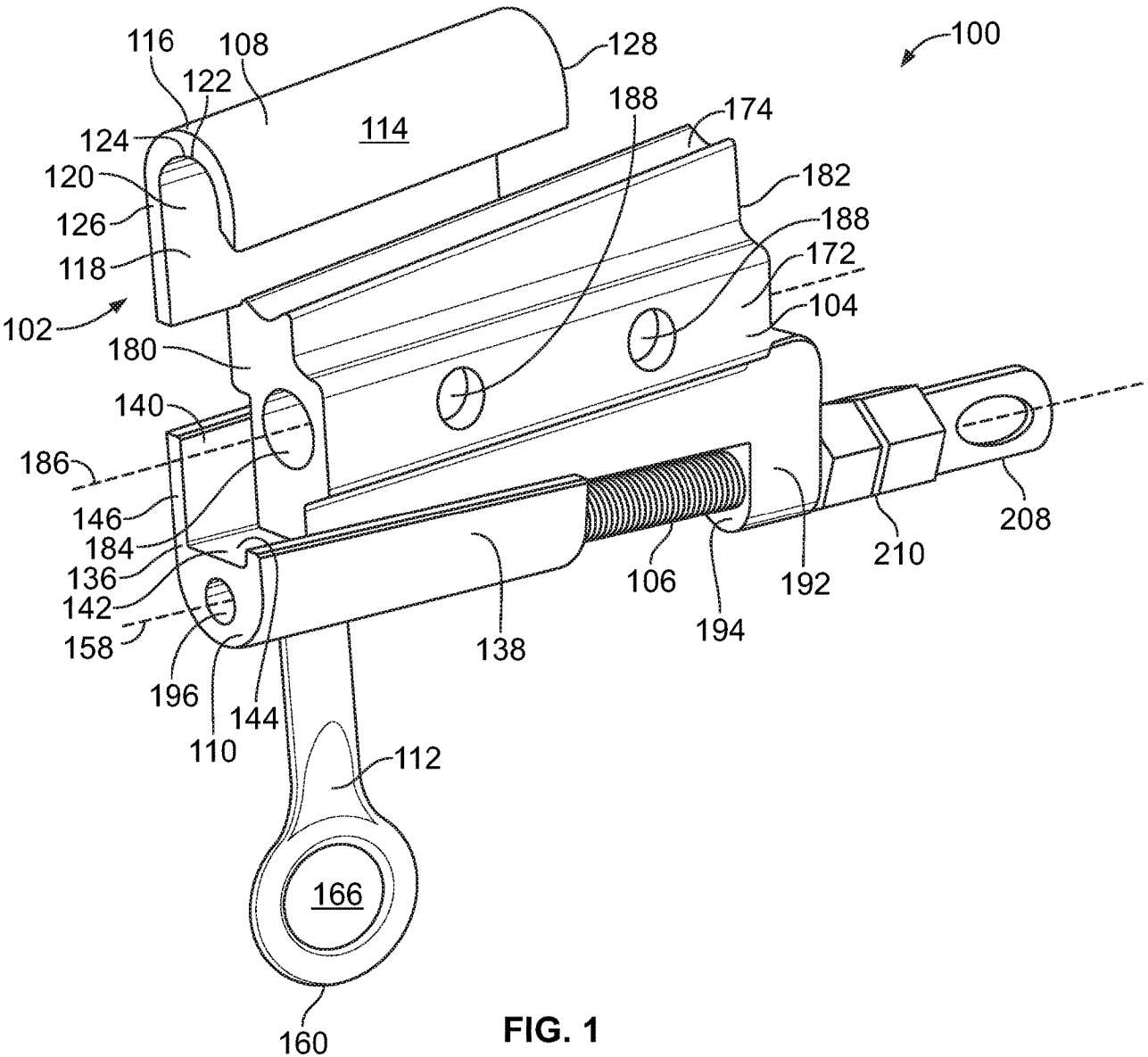
FIG. 1 illustrates a front side perspective view of a split wedge connector according to an illustrated embodiment of the subject application.

The foregoing summary, as well as the following detailed description of certain embodiments of the present application, will be better understood when read in conjunction with the appended drawings. For the purpose of illustrating the application, there is shown in the drawings, certain embodiments. It should be understood, however, that the present application is not limited to the arrangements and instrumentalities shown in the attached drawings. Further, like numbers in the respective figures indicate like or comparable parts.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates a front side perspective view of a split wedge connector 100 according to an illustrated embodiment of the subject application. As shown, the split wedge connector 100 can include a clamp assembly 102 and a wedge body 104, and can be constructed from a variety of different materials, including, for example, materials that can facilitate the operable electrical coupling, through the split wedge connector 100, of at least a tap line to a power line or cable. According to certain embodiments, the wedge body 104 can be directly or indirectly coupled to the clamp assembly 102, such as, for example, via an adjustable wedge driver 106. As discussed below, operation of the wedge driver 106, such as for example, rotation of the of the wedge driver 106, can facilitate linear displacement of at least one of the clamp assembly 102 and the wedge body 104 relative to the other of the clamp assembly 102 and the wedge body 104 so as to generate a wedge or compressive force against a power line positioned therebetween in manner that can both electrically couple and secure the split wedge connector 100 to the power line. Further, according to certain embodiments, such relative linear displacement can be accompanied by a sliding motion of at least one surface of the clamp assembly 102 or the wedge body 104 relative to power line in a manner that can generally clean at least a portion of the power line, such as, for example, facilitate the split wedge connector 100 rubbing the power line in a manner that can remove debris and/or oxidation from at least a portion of the power line.

Figure 2:
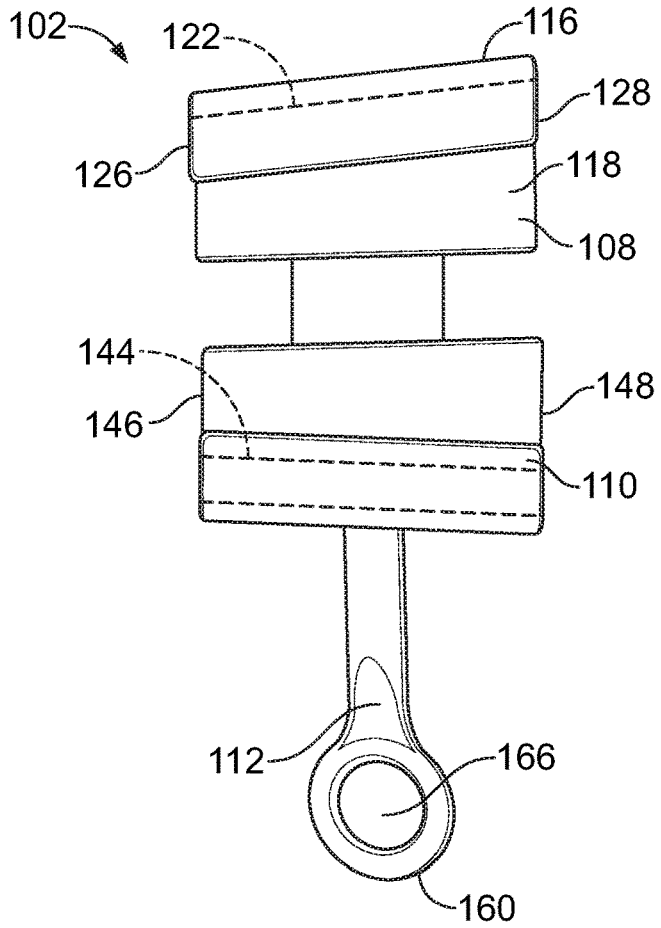
FIG. 2 illustrates a front side view of an exemplary clamp assembly for the split wedge connector depicted in FIG. 1.
Figure 3:
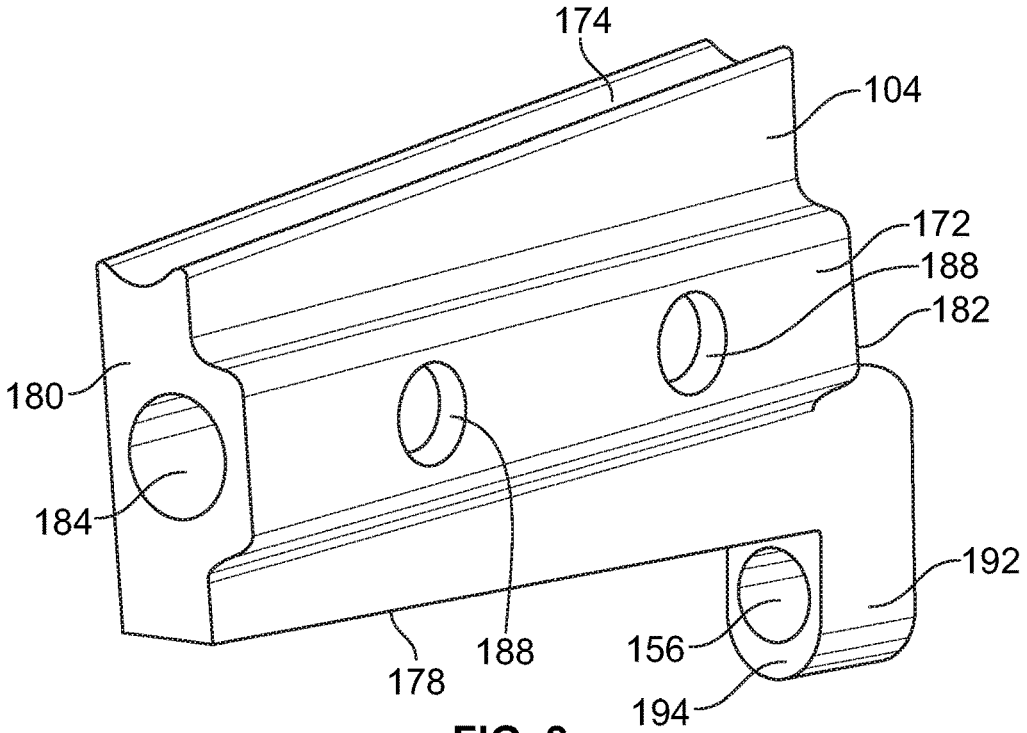
FIG. 3 illustrates a front side perspective view of an exemplary wedge body for the split wedge connector depicted in FIG. 1.
Figure 4:
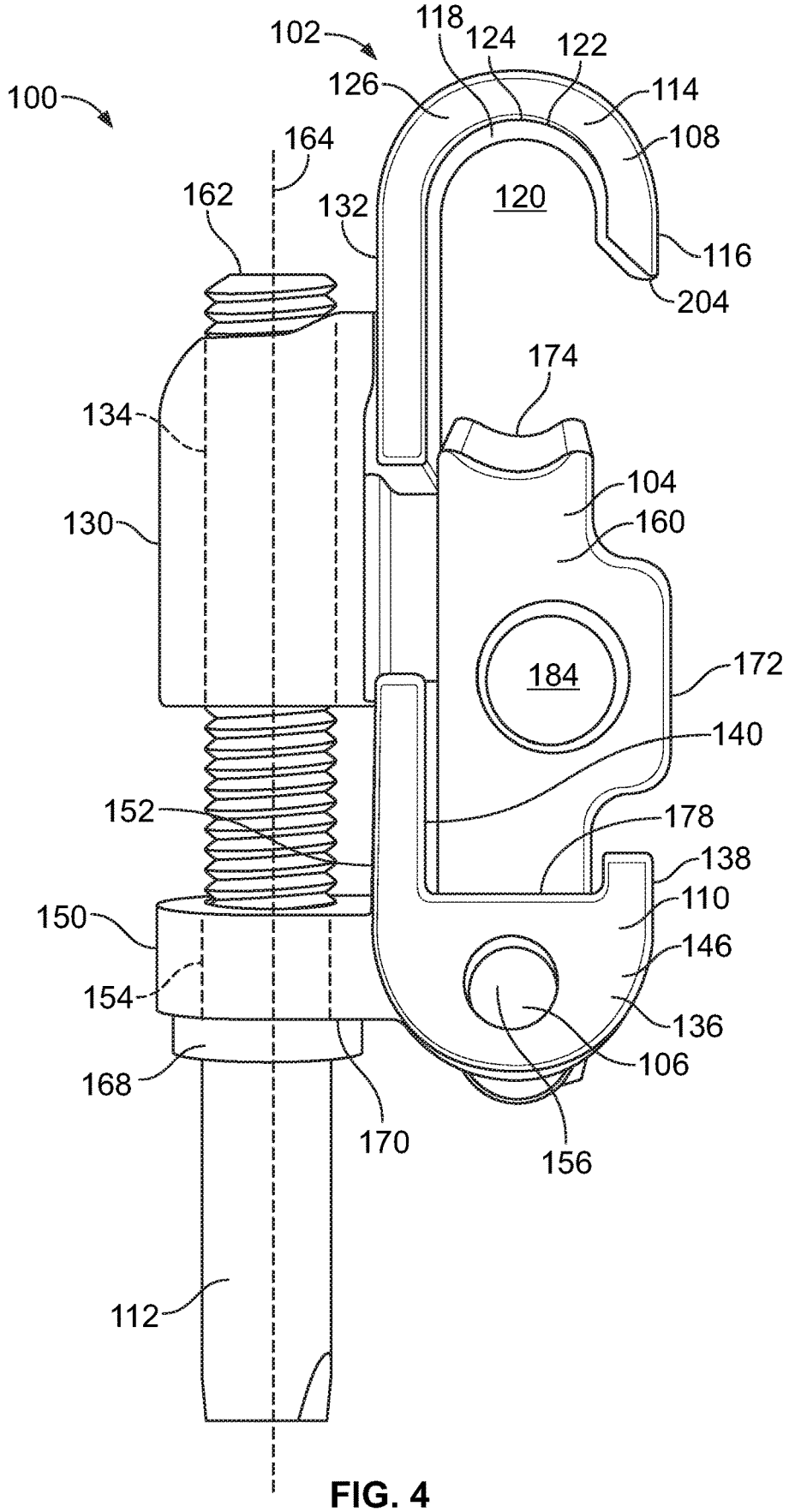
FIG. 4 illustrates a left side view of the split wedge connector depicted in FIG. 1.

As seen in at least FIGS. 2 and 4, the clamp assembly 102 cam comprise an upper clamp portion 108, a lower clamp portion 110, and an adjustable clamp driver 112. According to certain embodiments, the upper and lower clamp portions 108, 110 can provide a "C" shaped clamp, or C-clamp. Additionally, according to certain embodiments, the upper and lower clamp portions 108, 110 may be separate, or individual, components.

The upper clamp portion 108 includes an upper wall 114 having an outer side 116 and an inner side 118, the inner side 118 generally defining an upper orifice 120 of the clamp assembly 102. As shown by at least FIG. 4, at least a portion of the inner side 118 of the upper wall 114 can have a curved wall 122 such that the highest point of the upper orifice 120 is at an apex 124 of the curved wall 122. As shown by at least FIG. 2, the curved wall 122 can extend between a first side 126 and a second side 128 of the upper clamp portion 108. Accordingly, the curved wall 122 and opposing portion of the outer side 116 of the upper wall 114 can extend at an upward incline from the first side 126 to the second side 128 of the upper clamp portion 108.

Figure 5:
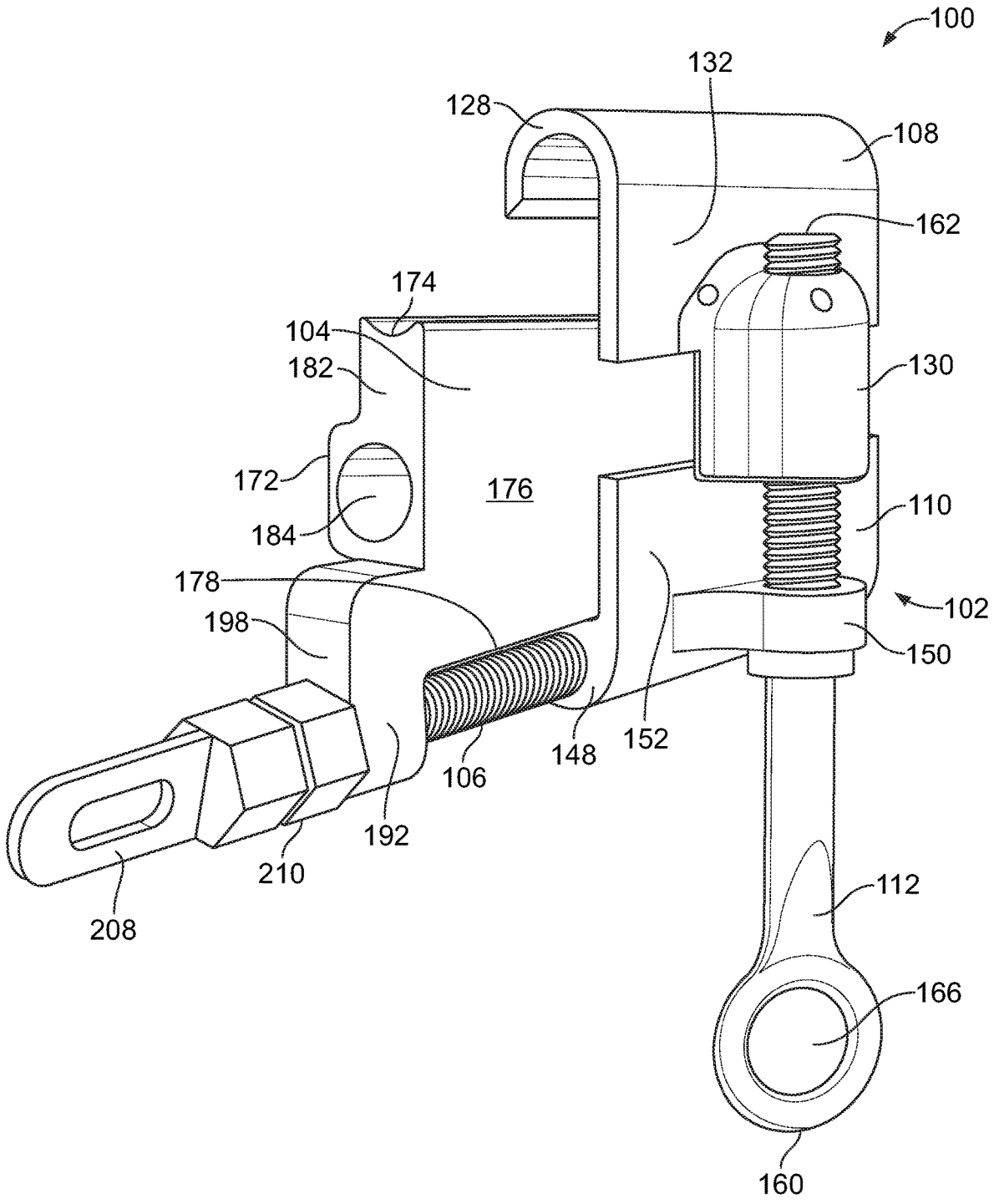
FIG. 5 illustrates a rear side perspective view of the split wedge connector depicted in FIG. 1 with a clamp assembly in an open position.

As seen by at least FIG. 5, an upper hub 130 can extend from a rear portion 132 of the outer side 116 of the upper wall 114 of the upper clamp portion 108 that is configured for operable engagement with the vertically extending clamp driver 112. For example, according to certain embodiments, the upper hub 130 can include an upper opening 134 having an internal thread that matingly engages a threaded portion of the clamp driver 112. Such engagement between the clamp driver 112 and the upper clamp portion 108 can be utilized to adjust a vertical position of the upper hub 130, and thus the upper clamp portion 108, relative to at least the lower clamp portion 110. Moreover, according to such an embodiment, the vertical position of the upper clamp portion 108 relative to the lower clamp portion 110 can be adjusted via adjusting the position of the upper clamp portion 108 through rotation of the clamp driver 112. Alternatively, according to other embodiments, the upper hub 130 can be configured such that the axial position of the upper clamp portion 108 remains relatively static relevant to the clamp driver 112, and operation of the clamp driver 112 axially displaces the lower clamp portion 110 relevant to the upper clamp portion 108.

The lower clamp portion 110 includes a lower wall 136 having an outer side 138 and an inner side 140, the inner side 140 generally defining a lower orifice 142 of the clamp assembly 102. As shown by at least FIG. 4, at least a portion of the inner side 140 of the lower wall 136 can provide a relatively flat abutment surface 144. As shown by at least FIG. 2, at least the abutment surface 144 and the opposing portion of the outer side 138 of the lower wall 136 can be oriented on a downwardly directed taper or decline from a first side 146 to a second side 148 of the lower clamp portion 110. Accordingly, in view of the decline configuration of the abutment surface 144 and the incline of the curved wall 122 between the corresponding first and second sides 126, 146, 128, 148 of the upper and lower clamp portions 108, 110, respectively, the curved wall 122 and the abutment surface 144 can extend toward their respective second sides 128, 148 at diverging directions away from each other.

Similar to the upper hub 130 of the upper clamp portion 108, a lower hub 150 can extend from a rear portion 152 of the outer side 138 of the lower wall 136 of the lower clamp portion 110 that is configured for operable engagement with the clamp driver 112. For example, as seen in at least FIG. 5, according to certain embodiments, the lower hub 150 can include a lower opening 154 having an internal thread that matingly receives a threaded portion of the clamp driver 112 such that rotation of the clamp driver 112 can adjust a vertical position of the lower clamp portion 110 relative to at least the upper clamp portion 108. Alternatively, according to other embodiments, the lower hub 150 can be configured such that the axial position of the lower clamp portion 110 remains relatively static relevant to the clamp driver 112, and operation of the clamp driver 112 axially displaces the upper clamp portion 108 relevant to the lower clamp portion 110. Further, as shown by at least FIG. 4, at least when the clamp assembly 102 is assembled, the upper opening 134 of the upper hub 130 can be generally aligned with the lower opening 154 of the lower hub 150 such that the clamp driver 112 horizontally extends through both the upper and lower openings 134, 154 in the upper and lower hubs 130, 150, respectively.

The lower clamp portion 110 further includes a first wedge orifice 196 that matingly engages the wedge driver 106. According to the exemplary embodiment, the first wedge orifice 196 is a through-hole that extends beneath the abutment surface 144, at least a portion of the first wedge orifice 196 having an internal thread that mates the external thread of the wedge driver 106. According to such an embodiment, operation of the wedge driver 106 can adjust a horizontal linear position of the wedge body 104 relative to at least the clamp assembly 102. Additionally, according to certain embodiments, the first wedge orifice 196 can extend along a central axis 158 (FIG. 1) that may, or may not, be generally parallel to the abutment surface 144. However, the lower clamp portion 110 can be connected to the wedge driver 106 in a variety of other matters and through the use of other configurations.

At least a portion of the clamp driver 112 can include a mechanical fastener, such as, for example, an external thread, among fasteners or connectors, which can threadingly engage mating threads of at least one of the upper and lower clamp portions 108, 110. According to the illustrated embodiment, the clamp driver 112 extends between a first end 160 and a second end 162 along a central axis 164 (FIG. 4) that is non-parallel to, and offset from, at least the central axis 158 of the first wedge orifice 196. The first end 160 of the clamp driver 112 can include an eyebolt 166 that is sized to be engaged by a hot stick, such as, for example, an insulated pole having a tool at one end that can operably engage one or more components of the split wedge connector 100. A midsection of the clamp driver 112 can include a retainer 168 having a size that is larger than adjacent portions of the clamp driver 112 such that the retainer 168 provides a shoulder 170 that abuts against at least a portion of a lower surface of the lower hub 150 at a location that is adjacent to the lower opening 154. Such a retainer 168 can be configured to limit the distance that the upper clamp portion 108 can be separated from the lower clamp portion 110 via operation of the clamp driver 112.

As seen in at least FIGS. 1 and 3-5, the wedge body 104 has a front wall 172, an upper wall 174, a rear wall 176, a lower wall 178, a first sidewall 180 and a second sidewall 182. As seen by at least FIG. 5, the rear wall 176 is configured to accommodate operation of the clamp assembly 102, and moreover accommodate linear displacement of either or both of the upper and lower clamp portions 108, 110 relative to each other.

According to the illustrated embodiment, the wedge body 104 can also include a passageway 184 that extends along a central axis 186 (FIG. 1) from the first sidewall 180 to the second sidewall 182 of the wedge body 104. The passageway 184 can be sized to accommodate passage of a cable, such as, for a tap line, through the passageway 184, and thus through the wedge body 104. According to certain embodiments, the passageway 184 may, or may not, be non-parallel to the central axis 158 of the first wedge orifice 196 of the lower clamp portion 110.

The front wall 172 can include one or more threaded openings 188 that extend into the passageway 184, and which are configured to matingly engage threaded fasteners 190 (FIGS. 6-9A), such as, for example, bolts, screws, or set screws, among other fasteners, that are used to secure at least the wedge body 104 to the tap line, or other cable, in the passageway 184. According to the illustrated embodiment, the threaded openings 188 are generally orthogonal to the central axis 186 of the passageway 184. Thus, when secured, the threaded fasteners 190 can press the inserted tap line, or other cable, against an opposing sidewall of the passageway 184 in a way that clamps or otherwise secures the tap line or cable to the wedge body 104.

The upper wall 174 of the wedge body 104 can incline from the first sidewall 180 to the second sidewall 182 of the wedge body 104. The angle of incline can be generally similar to the angle at which the curved wall 122 inclines between the first and second sides 126, 128 of the upper clamp portion 108. Additionally, the upper wall 174 of the wedge body 104 can have a generally curved shape that can provide a seat for a cable or line, such as, for example, a portion of an overhead power line. Thus, according to certain embodiments, the curvature of the upper wall 174 of the wedge body 104 can be sized to generally correspond the curvature of the portion of a cable or line that can be positioned against the upper wall 174.

The lower wall 178 of the wedge body 104 can be configured to slidingly abut the abutment surface 144 of the lower clamp portion 110. Thus, according to certain embodiments, the lower wall 178 of the wedge body 104 can be generally parallel to the abutment surface 144 of the lower clamp portion 110. Further, according to certain embodiments, the lower wall 178 can be non-parallel to the central axis 186 of the passageway 184 of the wedge body 104. Further, in view of the inclined configuration of at least the upper wall 174, the distance between the lower wall 178 and the upper wall 174 of the wedge body 104 can increase as the wedge body 104 extends from the first sidewall 180 to the second sidewall 182 of the wedge body 104.

According to the illustrated embodiment, the wedge body 104 can include a downwardly extending leg 192. The leg 192 can extend from the lower wall 178 and/or the second sidewall 182 of the wedge body 104, among other locations. According to certain embodiments, an inner wall 194 of the leg 192 is at a distance way from first sidewall 180 of the wedge body 104 such that the leg 192 does not prevent at least the lower clamp portion 110 from being linerally displaced relative to the lower wall 178 to a location that securely connects the split wedge connector 100 to an overhead power line, as discussed below. Further, according to the illustrated embodiment, the leg 192 includes a second wedge orifice 156 that can accommodate passage of the wedge driver 106 through the second wedge orifice 156 in the leg 192 and into the first wedge orifice 196 of the lower clamp portion 110. Thus, at least when the split clamp assembly 102 is assembled, the second wedge orifice 156 extends generally along the same central axis 158 as the first wedge orifice 196. According to certain embodiments, the second wedge orifice 156 can have an internal thread that mates an external thread of the wedge driver 106 such that rotation of the wedge driver 106 facilitates linear displacement of at least he wedge body 104 relative to at least the lower clamp portion 110 and/or the clamp assembly 102. Alternatively, the second wedge orifice 156 provides a passageway such that threaded engagement between the first wedge orifice 196 of the lower clamp portion 110 and the wedge driver 106 can cause a portion of the second wedge orifice 156 to abut an outer wall 198 of the leg 192 (FIG. 5) in a manner that facilitates the linear displacement of the wedge body 104 relative to the lower clamp portion 110 and/or clamp assembly 102.

Figure 6:
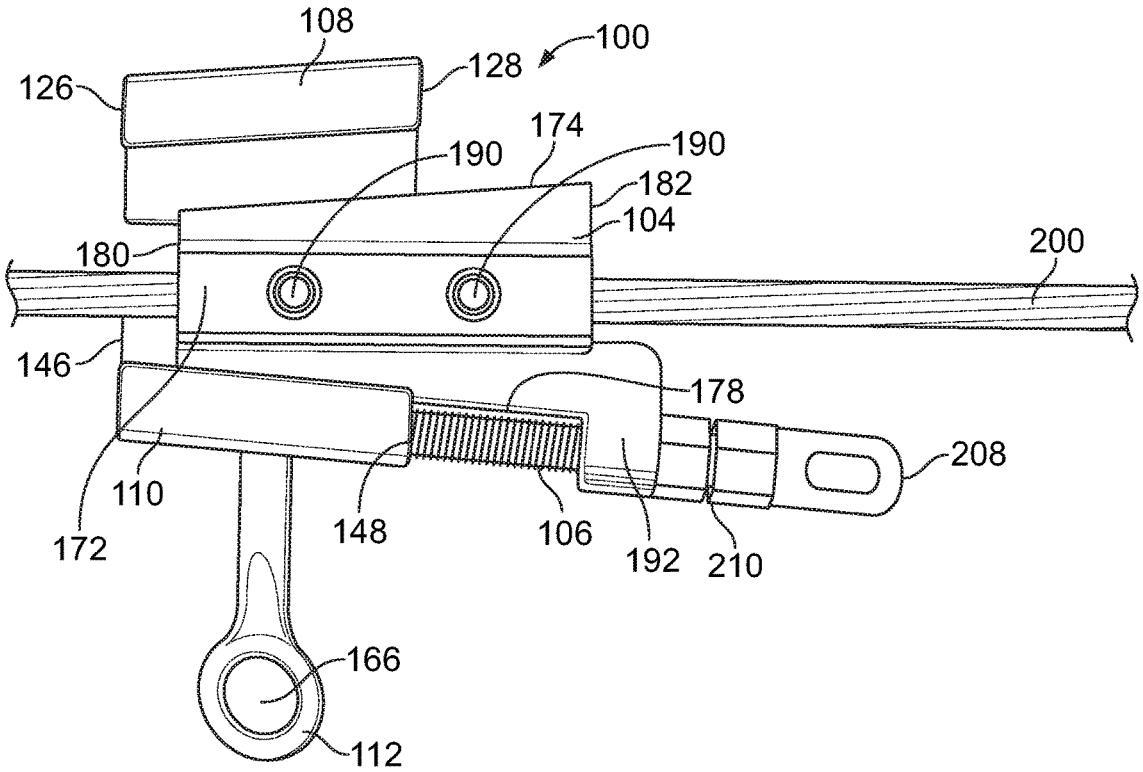
FIG. 6 illustrates a front side view of the split wedge connector depicted in FIG. 1 securely attached to a tap line.

FIG. 6 illustrates a front side view of the split wedge connector 100 depicted in FIG. 1 securely attached to a tap line 200. According to the illustrated embodiment, the tap line 200 can enter the passageway 184 of the wedge body 104 through either end of the passageway 184. Additionally, according to the illustrated embodiment, the tap line 200 is secured within the passageway 184 via the use of a pair of fasteners 190 that are threadingly engaged in the threaded openings 188 of the wedge body 104. According to certain embodiments, the split wedge connector 100 can be secured to the tap line 200 while the worker is standing at ground level. More specifically, at least in certain situations, the split wedge connector 100 can be secured to the tap line 200 without overhead operation by the worker. Thus, as the worker can secure the tap line 200 to the split wedge connector 100 while standing at ground level, the illustrated embodiment of the subject application can avoid traditional uses of another, separate connector that is often utilized to join the main power line and the tap line 200 together during installation of at least some traditional wedge connectors. Further, as shown in FIG. 6, with the wedge body 106 coupled to the clamp assembly 102, the wedge body 104 is at an initial position relative to the clamp assembly 106 such that the wedge body 106 is relatively remote from the first side 126, 146 of the upper and lower clamp portions 108, 110, respectively.

Figure 7:
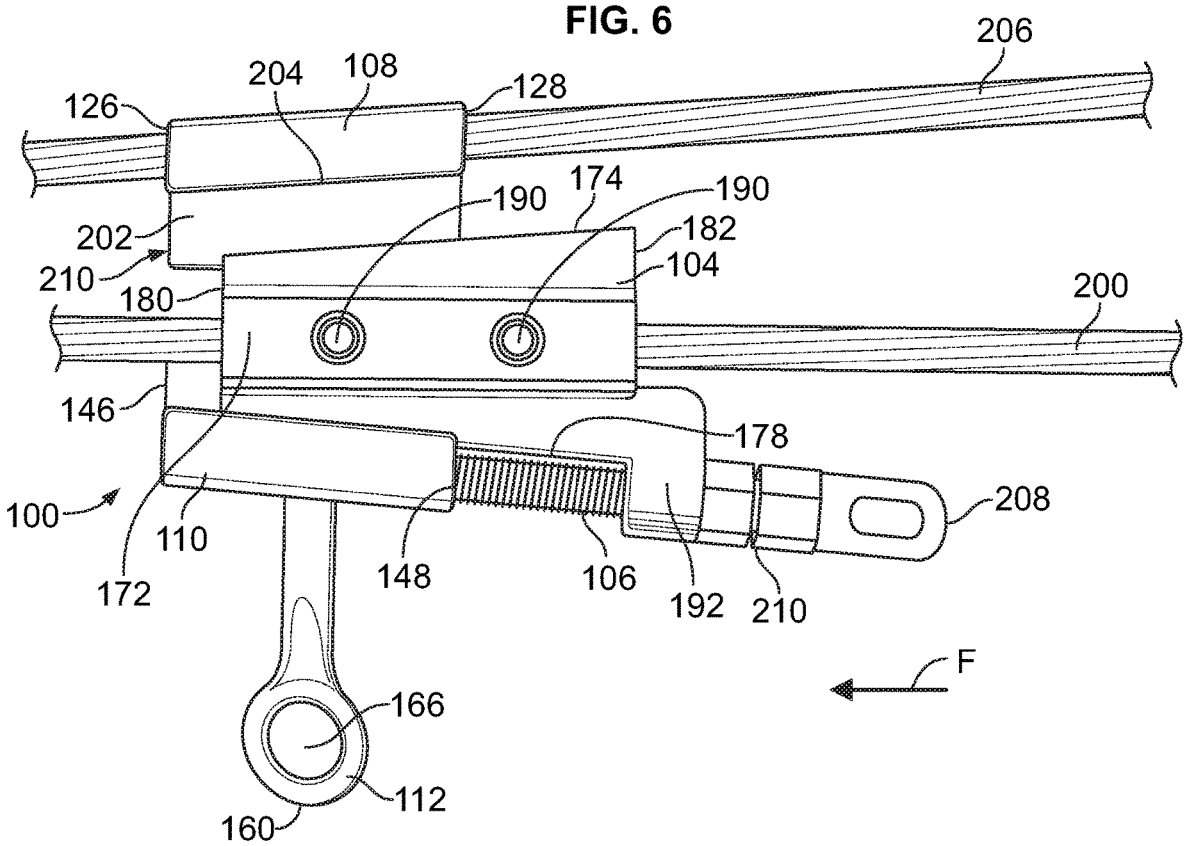
FIG. 7 illustrates a front side view of the split wedge connector both hanging from a power line and securely attached to a tap line, and a wedge body at an initial position relative to a clamp assembly.

As demonstrated below, the illustrated wedge connector 100 is all encompassing in that, once the tap line 200 is secured by the worker, which again can occur at ground level, the installation of the wedge connector 100 can occur without the wedge connector 100 being simultaneously engaged by a plurality of hot sticks, without the use of additional components, and/or without reliance on the use of lifting equipment, such as, for example, a cherry picker. More specifically, FIG. 6, as well as at least FIGS. 1 and 4-5, illustrate the clamp assembly 102 in an open position. For example, as shown by at least FIG. 4, when in the open position, the upper clamp portion 108 is separated from the lower clamp portion 110 by a distance that allows for the presence of a gap 202 between a terminal end wall 204 of the upper wall 114 of the upper clamp portion 108 and the upper wall 174 of the wedge body 104. When the clamp assembly 102 is in the open position, such a gap 202 can be sized to accommodate passage of an overhead power line through the gap 202 and into the upper orifice 120 of the upper clamp portion 108. With the clamp assembly 102 in an open position and the tap line 200 secured to the split wedge connector 100 via the threaded fasteners 190, a worker can engage the eyebolt 166 of the clamp driver 112 with a hot stick. Using the hot stick, the worker can then lift the split wedge connector 100 to a position at which an overhead power line 206 can pass through the gap 202 and into the upper orifice 120 of the upper clamp portion 108, as shown in FIG. 7. Again, such lifting of the split wedge connector 100 with the hot stick to a position at which the overhead power line 206 can be received in the split wedge connector 100 can occur without the use of a lift vehicle or associated equipment, including, for example, without a cherry picker, and instead can occur while the worker remains standing at ground level. Further, the shape of the upper wall 114 of the upper clamp portion 108, including, for example, at least the configuration of the inner side 118 of the upper clamp portion 108 in view of the C-shaped configuration provided by the combination of the upper and lower clamp portions 108, 110, provides the upper clamp portion 108 with a generally hook shaped configuration that can at least temporarily facilitate the split wedge connector 100 hanging from the overhead power line 206.

Figure 8A:
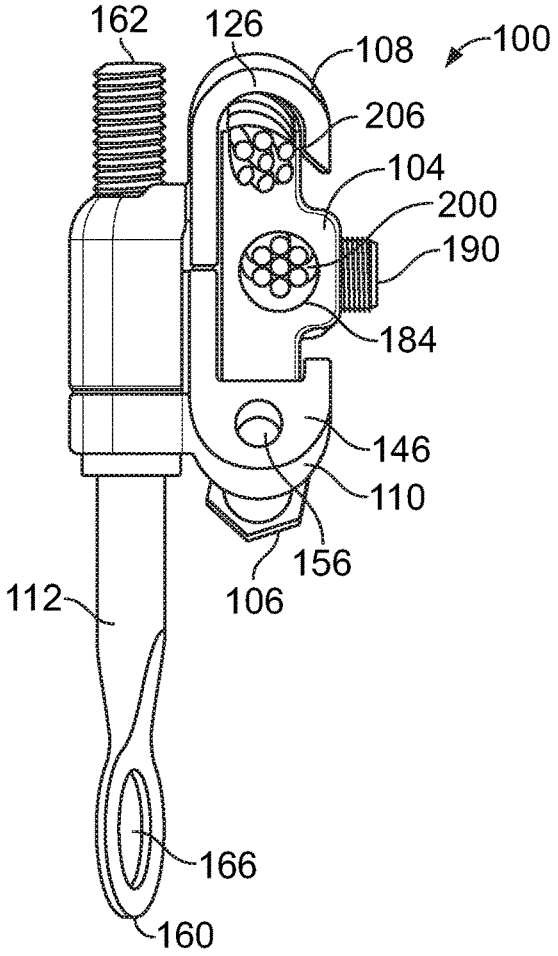
FIG. 8A illustrates a left side view of the split wedge connector positioned on an overhead line cable and a clamp assembly in a closed position.

With the overhead power line 206 in the upper orifice 120 of the upper clamp portion 108, and thus the split wedge connector 100 hanging from the overhead power line 206, the worker can use the hot stick to manipulate the clamp driver 112 such that the clamp assembly 102 is changed from an open position to a closed position. For example, the worker can rotate the hot stock so as to facilitate rotation of the clamp driver 112 such that at least one of the upper and lower clamp portions 108, 110 are linearly displaced into closer proximity of the other of the upper and lower clamp portions 108, 110 while the overhead power line 206 is positioned within the upper orifice 120 of the upper clamp portion 108. Thus, through use of the hot stick and to close the clamp assembly 102, the gap 202 between the terminal end wall 204 of the upper wall 114 of the upper clamp portion 108 and the upper wall 174 of the wedge body 104 can be reduced to size, and/or eliminated, so as to prevent the power cable from passing out of the upper orifice 120 of the upper clamp portion 108. FIG. 8A illustrates an example of the clamp assembly 102 in the closed position and with the overhead power line 206 retained within the upper orifice 120 of the upper clamp portion 108. The worker can then remove the hot stick from engagement with the eyebolt 166 of the clamp driver 112.

Figure 8B:
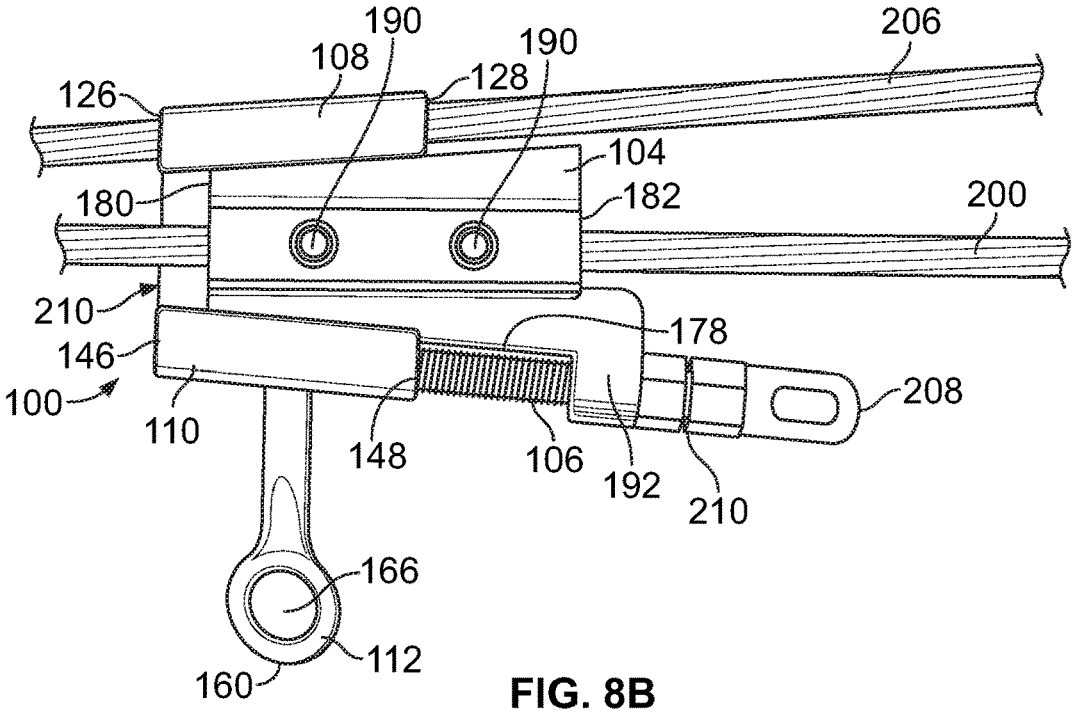
FIG. 8B illustrates a front side view of a split wedge connector with a wedge body at an intermediate position relative to a clamp assembly.

With the hot stick removed from engagement with the clamp driver 112, the worker can then proceed to operably engage the hot stick with the wedge driver 106. For example, according to certain embodiments, the wedge driver 106 can be a shear bolt having an eyebolt 208 that can be matingly coupled to the hot stick. Moreover, using the engagement of the hot stick with the eyebolt 208 of the wedge driver 106, the worker can rotate the wedge driver 106 such that the at least the threaded engagement between the wedge driver 106 and the first wedge orifice 196 in the lower clamp portion 110 facilitates linear displacement of the wedge body 104 in a generally forward direction (as indicated by the "F" direction in FIG. 7) toward the clamp assembly 102. For example, via such operation of the wedge driver 106, the wedge body 104 can be displaced relative to the clamp assembly 102 from an initial position, as shown in FIG. 7, to an intermediate position, as shown in FIG. 8B. As shown, with such movement, the wedge body 104 moves into closer proximity to a first end 210 of the clamp assembly 102. Further, in view of the inclined orientation of the upper wall 174 of the wedge body 104, such movement of the wedge body 104 can coincide with a decrease in the distance separating portions of the upper wall 174 of the wedge body 104 from adjacent portions of the at least the curved wall 122 of the inner side 118 of the upper clamp portion 108. In at least certain situations, as the distance between the upper wall 174 of the wedge body 104 and adjacent portions of the at least the curved wall 122 are decreased, the power line 206 positioned therebetween can, to at least some degree, be at least partially compressed between the upper wall 174 of the wedge body 104 and the inner side 118 of the upper clamp portion 108. Further, sliding movement of at least the upper wall 114 of the upper clamp portion 108 against an adjacent surface of the power line cable can at least partially clean at least that portion of the power line cable, such as, for example, provide an abrasive rubbing force that can at least partially remove debris, or other build-up, such as oxidation, that may have developed on the overhead power line 206. Additionally, during such relative movement of at least the wedge body 104, at least a portion of the lower wall 178 of the wedge body 104 can slide along the abutment surface 144 of the lower clamp portion 110, and vice versa.

Figure 9A:
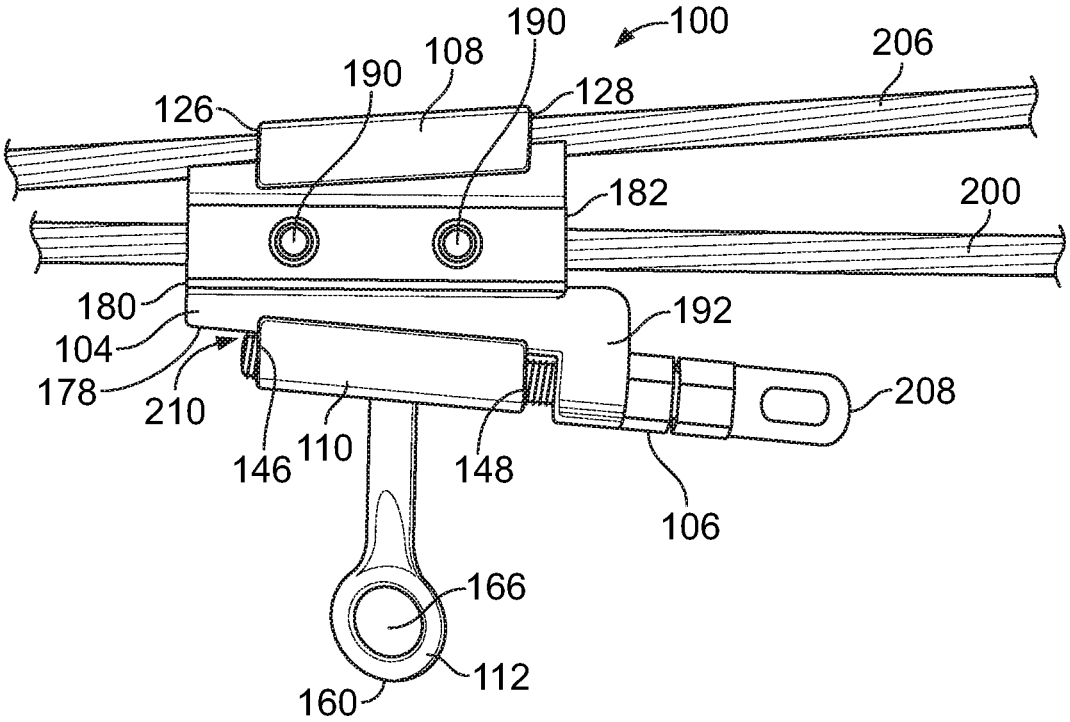
FIG. 9A illustrates a front side view of a split wedge connector at an end position relative to at least the clamp assembly.
Figure 9B:
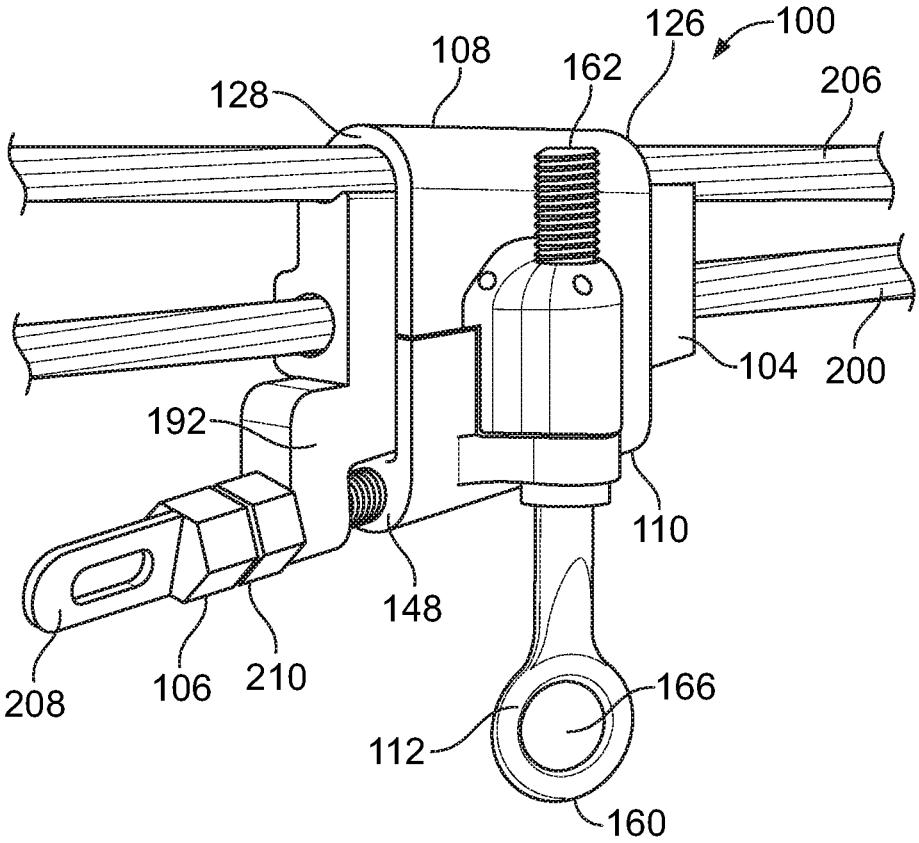
FIG. 9B illustrates a left side view of the split wedge connector at the end position, as depicted in FIG. 9A.

Continued manipulation of the wedge driver 106, such as, for example, via operation of the hot stick and its operable engagement with the eyebolt 208 of the wedge driver 106, can further facilitate the continued displacement the wedge body 104 in the forward direction relative to at least the clamp assembly 102 from the intermediate position, as shown in FIG. 8B, to an end position, as shown in FIG. 9A. Again, as the wedge body 104 is displaced, the lower wall 178 of the wedge body 104 can continue to slide along the abutment surface 144 of the lower clamp portion 110. Further, as shown, continued displacement of the wedge body 104 in the forward direction relative to at least the clamp assembly 102 can further bring the inclined upper wall 174 of the wedge body 104 into closer proximity to adjacent portions of at least the curved wall 122 of the inner side 118 of the upper clamp portion 108, and thereby further increase the compressive forces being exerted the portion of the overhead power line 106 that is positioned between the upper wall 174 of the wedge body 104 and the inner side 118 of the upper clamp portion 108. Moreover, such compression can securely wedge the overhead power line 206 between the wedge body 104 and the upper clamp portion 108 in a manner that securely couples the split clamp assembly 102 to the overhead power line 206, while also potentially enhancing the electrical contact between the overhead power line 206 and the split wedge connector 100. Additionally, such continued sliding movement of the wedge body 104 along at least the overhead power line 206 can also continue to remove debris and/or oxidation from at least a portion of the outer surface of the overhead power line 206.

According to certain embodiments, the wedge driver 106 can be constructed to provide an indication as to when the wedge body 104 has been displaced to a position that provides sufficient wedging forces to retain the split wedge connector 100 in secure engagement with the overhead power line 206. According to certain embodiments, such an indication can be associated with an indication that the split wedge connector 100 is secured to the overhead power line 206 with sufficient force to withstand temperature changes and conductor compaction over an extended period of time. For example, according to certain embodiments, the eyebolt 208 of the wedge driver 106 include a shear feature, as shown, for example, by the shear line 210 shown in at least FIG. 9A. According to such an embodiment, the shear line 210 can be configured to correspond with a torque needed to further displace the wedge body 104 beyond the final position shown in FIG. 9A. Thus, according to the illustrated embodiment, during installation, once the wedge body 104 has reached its final position, further attempts to displace the wedge body 104 in the forward direction relative to the clamp assembly 102 may require the application of a level or degree of torque on the wedge driver 106 that exceeds the torque that can be tolerated by the shear line, and thus causes the wedge driver 106 to shear at the shear line 210. Such shearing can therefore provide an indication to the worker that the split wedge connector 100 is securely connected to the overhead power line 206.

With the split wedge connector 100 secured to the overhead power line 206, the clamp assembly 102 can continue to assist in maintaining the split wedge connector 100 in secure engagement with the overhead power line 206, including secure engagement over a relatively long time period and during temperature changes in the split wedge connector 100, power line 206, and/or surrounding environment, among other changes. More specifically, the generally C-shape of the clamp assembly 102 can provide a spring clamp load on the power line 206. Such a spring clamp load can, for example, prevent the split wedge connector 100 from loosening, over time, from the overhead power line 206, including loosening that could otherwise be associated with thermal expansion and movement.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A split wedge connector comprising:

a wedge body having an upper wall, a lower wall, and a passageway, the upper wall extending along an incline between a first sidewall and a second sidewall of the wedge body, the passageway comprising a through-hole that extends through the wedge body;

a clamp assembly comprising an upper clamp portion, a lower clamp portion, and a clamp driver, the clamp driver configured to vertically displace the clamp assembly between an open position and a closed position, the upper clamp portion having an inner surface that defines an upper orifice, at least a portion of the inner surface defining the upper orifice comprising an inclined wall, the clamp driver having an eyebolt; and a wedge driver coupled to the wedge body and the lower clamp portion, the wedge driver configured to horizontally displace at least one of the wedge body and the clamp assembly relative to the other of the wedge body and the clamp assembly, the wedge driver having an eyebolt, wherein at least a portion of the lower wall of the wedge body slidingly abuts an abutment surface of the lower clamp portion while at least a portion of the upper wall faces the inclined wall.

2. The split wedge connector of claim 1, wherein the inclined wall has a curved profile.

3. The split wedge connector of claim 1, wherein the wedge body further comprises a front wall, the front wall having a threaded opening that is non-parallel to, and in fluid communication with, the passageway.

4. The split wedge connector of claim 1, wherein the upper wall of the wedge body has a curved profile.

5. The split wedge connector of claim 1, wherein the passageway is sized to receive a tap line and the upper orifice is sized to receive a power line.

6. The split wedge connector of claim 1, wherein the incline along which the upper wall extends is generally the same as the incline of the inclined wall of the inner surface of the upper clamp portion.

7. The split wedge connector of claim 1, wherein the wedge driver comprises a shear bolt.

8. The split wedge connector of claim 1, wherein the clamp driver is threadingly engaged with at least one of the upper clamp portion and the lower clamp portion.

9. The split wedge connector of claim 8, wherein the clamp driver is threadingly engaged with an internal thread in an upper hub of the upper clamp portion and/or an internal thread of a lower hub of the lower clamp portion.

10. The split wedge connector of claim 1, wherein the lower clamp portion includes a first wedge orifice and the wedge body includes a second wedge orifice, the first wedge orifice being generally aligned with the second wedge orifice, the first and second wedge orifices configured to each receive at least a portion of the wedge driver.

11. The split wedge connector of claim 10, wherein the wedge driver threadingly engages an internal thread of at least one of first wedge orifice and the second wedge orifice.

12. The split wedge connector of any one of claim 10, wherein the wedge body further includes a leg that extends from at least one of the lower wall and a sidewall of the wedge body, and wherein the second wedge orifice extends through the leg.

13. A method comprising:

inserting a tap line through a passageway of a wedge body of a split wedge connector, the split wedge connector further including a clamp assembly;

lifting, using a hot stick and with the clamp assembly in an open position, the split wedge connector;

receiving, while the split wedge connector is lifted, a portion of an overhead power line in an orifice of the clamp assembly;

closing, with the overhead power line in the orifice of the clamp assembly of the lifted split wedge connector, the clamp assembly;

displacing, through manipulation of a wedge driver via the hot stick, the wedge body relative to the clamp assembly from an initial position to a final position; and compressing, by displacing the wedge body relative to the clamp assembly to the final position, at least a portion of the overhead power line located in the orifice of the clamp assembly.

14. The method of claim 13, further comprising shearing, when the wedge body reaches the final position, a portion of the wedge driver via manipulation of the hot stick.

15. The method of claim 13, wherein closing the clamp assembly comprises rotating, via operation of the hot stick, a clamp driver to facilitate displacement of at least one of an upper clamp portion and a lower clamp portion of the clamp assembly toward the other of the upper clamp portion and the lower clamp portion.

16. The method of claim 13, wherein displacing the wedge body through manipulation of the wedge driver via the hot stick includes rotating the wedge driver via use of the hot stick.

17. The method of claim 13, further including securing the tap line in the passageway.

18. The method of claim 17, wherein securing the tap line comprises inserting a fastener into the passageway, the fastener pressing a portion of the tap line against an inner wall of that defines at least a portion of the passageway.

* * * * *